US005379529A

United States Patent [19]

Smith et al.

[11] Patent Number: 5,379,529

[45] Date of Patent: Jan. 10, 1995

[54] TONGUE STRAPPING SYSTEM FOR A SHOE UPPER

[75] Inventors: Steven F. Smith, Taunton; Peter M. Foley, Needham, both of Mass.

[73] Assignee: Reebok International Ltd., Stoughton, Mass.

[21] Appl. No.: 253,203

[22] Filed: Jun. 2, 1994

Related U.S. Application Data

[63] Continuation of Ser. No. 971,627, Nov. 5, 1992, abandoned.

[51] Int. Cl.[6] ..... A43B 23/26

[52] U.S. Cl. ..... 36/54; 36/50.1; 36/92

[58] Field of Search ..... 36/50.1, 54, 56, 69, 36/89, 92, 68, 51, 52, 53, 88, 99, 114

[56] References Cited

U.S. PATENT DOCUMENTS

| | | | |
|---|---|---|---|
| 205,129 | 6/1878 | Packard . | |
| 1,028,598 | 6/1912 | Papp | 36/54 |
| 1,184,013 | 5/1916 | Pierce . | |
| 1,261,152 | 4/1918 | Mullarky | 36/89 |
| 1,275,895 | 8/1918 | Fox | 36/54 |
| 1,545,623 | 7/1925 | Westfall | 36/89 |
| 1,663,221 | 3/1928 | Scroggins | 36/89 |
| 1,708,156 | 4/1929 | Scroggins | 36/89 |
| 4,245,408 | 1/1981 | Larsen et al. | 36/50 |
| 4,282,657 | 8/1981 | Antonious | 36/50 |
| 4,366,631 | 1/1983 | Larsen et al. | 36/50 |
| 4,577,419 | 3/1986 | Chassaing | 36/89 |
| 4,811,500 | 3/1989 | Maccano | 36/91 |
| 4,811,502 | 3/1989 | Barret | 36/117 |
| 4,845,864 | 7/1989 | Corliss | 36/131 |
| 5,319,869 | 6/1994 | McDonald et al. | 36/114 |

FOREIGN PATENT DOCUMENTS

| | | | |
|---|---|---|---|
| 1124060 | 5/1982 | Canada . | |
| 251105 | 10/1947 | Switzerland . | |
| 121573 | 12/1918 | United Kingdom | 36/54 |
| 667259 | 2/1952 | United Kingdom . | |

OTHER PUBLICATIONS

Avia Spring 1989 Catalog, p. 14, Shoe Model #868.
Avia Spring 1993 Catalog, Shoe Model #2075.

*Primary Examiner*—Paul T. Sewell
*Assistant Examiner*—Thomas P. Hilliard
*Attorney, Agent, or Firm*—Sterne, Kessler, Goldstein & Fox

[57] ABSTRACT

A shoe upper is provided having a tongue strapping system. A tongue is provided having two or more straps which extend through apertures formed in the sides of the shoe upper. When the tongue strapping system is implemented, the straps serve to create pressure between different portions of the shoe upper, resulting in a secure and enhanced fit.

23 Claims, 2 Drawing Sheets

TONGUE STRAPPING SYSTEM FOR A SHOE UPPER

This application is a continuation of application Ser. No. 07/971,627, filed Nov. 5, 1992, now abandoned.

BACKGROUND OF THE INVENTION

1. Field of the Invention

This invention relates generally to footwear, and more particularly to athletic footwear having a combined tongue and strap system which helps secure the foot of the wearer within the footwear, thereby providing an enhanced fit.

2. Description of Related Art

One of the problems associated with athletic shoes has always been the lack of a customized, snug fit. Most conventional athletic shoes have a single lacing margin or eyestay opening closed by shoe lace. This structure does not adequately secure the foot of a wearer within the shoe, as the shoe lace merely pulls the eyestay opening closed, thereby leaving a great deal of open space or gaps within the shoe.

Accordingly, when athletic activity is undertaken in conventional athletic shoes, the foot of the wearer often has too much mobility within the shoe, such that the foot alternately slides forwardly toward the forepart and slides rearwardly toward the rear part of the shoe. The foot of the wearer also tends to have too much lateral mobility within the shoe, such that the foot can "roll over" during athletic activity. In addition, the heel of the foot of the wearer often tends to slip vertically in and out of the shoe. These movements can cause discomfort for the wearer, especially in the toe and heel regions of the foot, where blisters often develop. Also, ankle sprains and other injuries often result when a foot has too much mobility within a shoe. Accordingly, numerous attempts have been made over the years to incorporate means into athletic shoes which better secure the foot of the wearer within the shoe.

It is known to attempt to enhance the fit of a shoe through the use of various securement straps. U.S. Pat. No. 4,811,502 to Barret discloses a shoe having three flexible ties located within the shoe. Each tie is attached to the shoe sole. Two of the ties extend through guides located within the shoe, and exit the shoe through eyelets. The shoe is tightened by pulling the exposed ties and fastening them together. This shoe has the disadvantage of causing wearer discomfort. The fastening ties overlap a substantial portion of the wearer's foot, thereby causing undue pressure and overly constricting the foot. Furthermore, the flexible tie in the rear part of the shoe comprises a thin strap which crosses over the achilles tendon of the wearer, resulting in uneven forward pressure being applied to the rear part of the foot, and causing further discomfort for the wearer. In addition, the flexible tie in the rear applies pressure downwardly towards the sole of the shoe, resulting in inadequate pressure being applied between the instep portion and the heel portion of the shoe.

U.S. Pat. No. 4,811,500 to Maccano discloses a shoe having straps secured to a sling member which underlies the foot of the wearer. The straps extend upwardly and exit the shoe at openings near the lacing portion, where they are fastened together by lacing or other means. Canadian Patent No. 1,124,060 to Higgins discloses a shoe having a reinforcement member with straps extending therefrom. Neither of the shoes described in these patents provides downward pressure from the instep portion toward the heel portion beyond that which a conventionally laced shoe offers. In addition, the Maccano shoe provides inadequate upward pressure from the heel portion of the shoe toward the instep portion, as the tension is applied upwardly from the middle of the base of the shoe, rather than forwardly and upwardly from the heel portion of the shoe.

Attempts have also been made to enhance the fit of a shoe using straps with "hook and loop" or VELCRO®-type fastening means, as is done in U.S. Pat. No. 4,845,864 to Corliss, U.S. Pat. No. 4,282,657 to Antonious, and U.S. Pat. No. 4,577,419 to Chassaing. The Corliss shoe has the drawback of providing virtually no additional pressure from the heel portion of the shoe toward the instep portion thereof. The Antonious patent discloses a shoe having numerous embodiments, each of which includes a heel restraint having an anchor strap and a fastener strap. This shoe has the disadvantage of applying uneven and sometimes inadequate pressure between the instep and heel portions of the shoe. In addition, the straps in some of the embodiments disclosed in this patent pull unevenly across the top of the instep portion.

U.S. Pat. Nos. 4,366,631 and 4,245,408 to Larsen teach a shoe having D-shaped eyelets fastened to the outside of the shoe. These shoes seek to pull the heel portion of the shoe forward through conventional lacing means combined with the additional D-shaped eyelets disposed on each side of the shoe. The shoe lace of the shoes disclosed in the Larsen patents is exposed on the sides of the shoe, which is undesirable as the lace can easily become caught on other objects.

It is also known to use a tongue having an integral strap to fasten a Shoe opening. U.S. Pat. No. 205,129 to Packard discloses a shoe having a tongue with a wing or flap, and a buckle which overlies the tongue. U.S. Pat. No. 1,184,013 to Pierce discloses a shoe having an instep-hood with two straps attached thereto. British Patent No. 667,259 to Shillock discloses a boot having a tongue with straps which are stitched to the inside of the boot. Swiss Patent No. 251,105 to Genecard also discloses a shoe with a tongue having straps. None of these patents, however, attempt to secure the foot of a wearer within the shoe upper by providing increased pressure within the shoe, wherein the instep portion of the shoe is pulled toward the heel portion, and the heel portion is pulled toward the instep portion.

Accordingly, prior to the development of the present invention, there was not a shoe which used a combined tongue and strap system to secure the foot of a wearer within the shoe by providing reciprocal pressure between the instep and heel portions of the shoe upper. Further, those shoes which have attempted to use straps to secure the foot of a wearer within the shoe have had such drawbacks as diminished comfort of the shoe, diminished flexibility of the shoe, undue constriction of the foot of a wearer, and uneven pressure applied to the foot of a wearer.

Therefore, it is an object of the present invention to provide an athletic shoe having an enhanced fit.

It is a further object of the present invention to provide an athletic shoe which reduces the lateral, horizontal and vertical movement of a wearer's foot within the shoe.

It is a further object of the present invention to provide an athletic shoe which provides added pressure between the instep and heel portions of the shoe without diminishing the flexibility or comfort of the shoe.

It is a further object of the present invention to provide an athletic shoe having a combined tongue and strap system which helps secure the foot of a wearer within the shoe.

SUMMARY OF THE INVENTION

To achieve the foregoing and other objects, and in accordance with the purposes of the present invention, as embodied and broadly described herein, the shoe of the present invention comprises a sole and an upper attached to the sole. The upper has a first side and a second side which define a top opening. A first aperture is disposed on the first side of the upper; a second aperture is disposed on the second side of the upper. A tongue is affixed to and disposed within the upper adjacent the top opening. A first strap is disposed on the tongue and extends through the first aperture to the exterior of the upper. A second strap is disposed on the tongue and extends through the second aperture to the exterior of the upper. A fastening means is disposed on the upper for securing the first and second straps about the foot of a wearer.

The shoe may further comprise a retaining means disposed on the upper for receiving one of the first and second straps. The retaining means may comprise a sleeve, which may disposed on one of the first and second sides of the upper between one of the first and second apertures and the top opening.

The upper may further comprise a heel end, and the first and second apertures may be disposed on the upper adjacent the heel end. The upper may further comprise a forefoot portion, and the first and second apertures may be disposed on the upper adjacent the forefoot portion.

The shoe may further comprise a third aperture disposed on the first side of the upper and a fourth aperture disposed on the second side of the upper. A third strap may be disposed on the tongue and extend through the third aperture to the exterior of the upper. A fourth strap may be disposed on the tongue and extend through the fourth aperture to the exterior of the upper. The fastening means may secure the third and fourth straps about the foot of a wearer.

The upper may further comprise a collar, and the first and second apertures may be disposed on the upper adjacent the collar. The first and second apertures may be reinforced. The first and second straps may be intregal with the tongue, and the first and second straps may each include an opening for receiving the fastening means. The fastening means may comprise a shoe lace.

Alternatively, the shoe of the present invention comprises a sole and an upper attached to the sole, wherein the upper has a lateral side and a medial side defining a top opening which includes an ankle opening and a lacing margin. A plurality of eyelets are disposed along the lacing margin. A first lateral aperture is disposed on the lateral side of the upper; a first medial aperture is disposed on the medial side of the upper. A lateral retaining means is disposed on the lateral side of the upper between the first lateral aperture and the lacing margin. A medial retaining means is disposed on the medial side of the upper between the first medial aperture and the lacing margin. A tongue is affixed to and disposed within the top opening of the upper. The tongue includes a first lateral strap and a first medial strap extending from opposing sides of the tongue. An opening is disposed on the first lateral strap, and an opening is disposed on the first medial strap. A fastening means is disposed on the upper for securing the first lateral strap and the first medial strap about the foot of a wearer.

The shoe may further comprise a second lateral aperture disposed on the lateral side of the upper and a second medial aperture disposed on the medial side of the upper. A second lateral strap may be disposed on a side of the tongue and a second medial strap may be disposed on an opposing side of the tongue. An opening is disposed on the second lateral strap, and an opening is disposed on the second medial strap. The fastening means secures the second lateral strap and the second medial strap about the foot of a wearer. The upper may further comprise a heel end, and the first lateral aperture and the first medial aperture may be disposed on the upper adjacent the heel end. The upper may further comprise a forefoot portion, and the second lateral aperture and the second medial aperture may be disposed on the upper adjacent the forefoot portion. The first lateral aperture, the first medial aperture, the second lateral aperture and the second medial aperture may all be reinforced. The first lateral strap, the first medial strap, the second lateral strap and the second medial strap may all be integral with the tongue.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

The accompanying drawings illustrate a shoe incorporating the tongue strapping system of the present invention. The tongue strapping system serves to create pressure between different portions of the shoe upper, resulting in a secure and enhanced fit.

Figure 1:
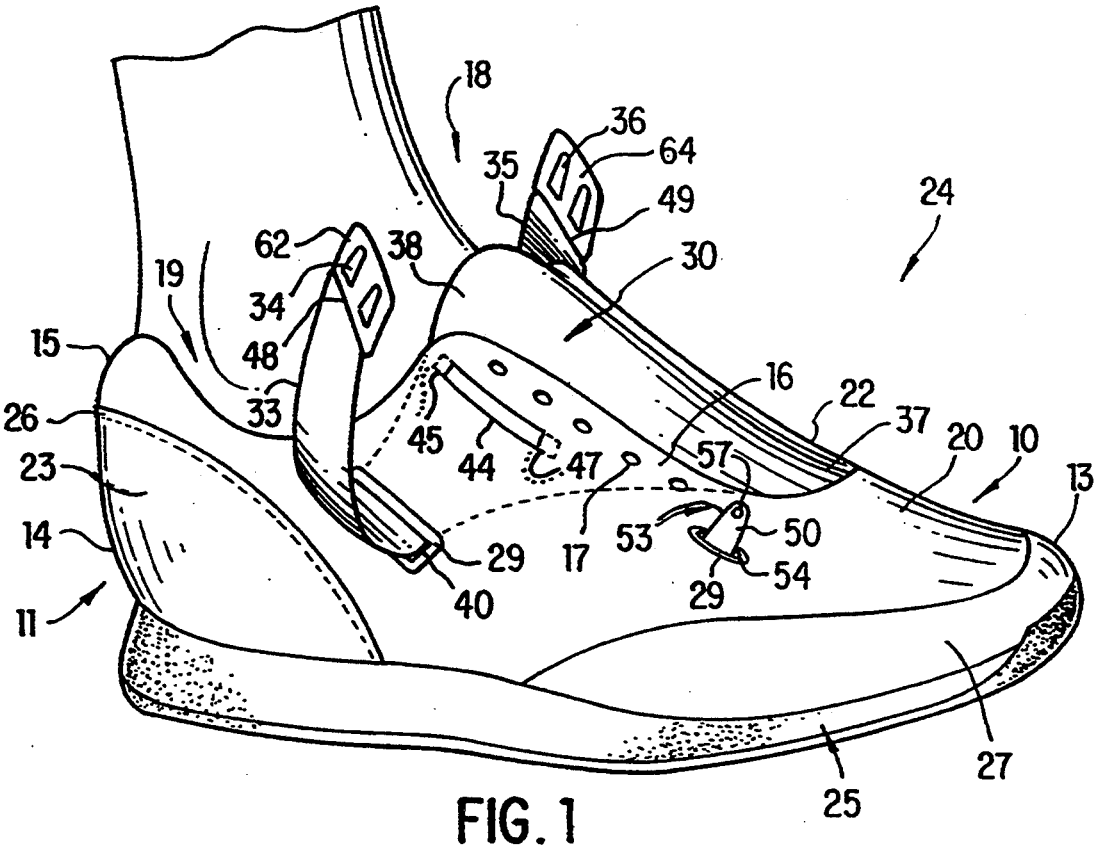
FIG. 1 is a perspective view of the lateral side of a shoe in accordance with the present invention.

Referring to the accompanying drawings, FIG. 1 is a perspective view of the lateral side of a shoe 24 in accordance with the present invention. Shoe 24 includes a sole, designated generally as 25, and an upper, designated generally as 10. Shoe upper 10 is preferably formed of a flexible material such as leather, nylon, canvas, or a combination thereof, as is known in the art. Shoe sole 25 is preferably formed of a cushion material such as rubber, polyurethane (PU), ethyl vinyl acetate (EVA), or a combination thereof, as is known in the art. Upper 10 is attached to sole 25 by any conventional technique.

Shoe upper 10 encompasses the foot of a person wearing the shoe, while shoe sole 25 provides support and cushioning therefor. Shoe upper 10 includes a toe end 13 disposed at the forward end of shoe upper 10 adjacent the toes of the foot of a wearer. Shoe upper 10 further includes a forefoot portion 22 disposed rearwardly of toe end 13, and a heel end 14 which is disposed at the rear of shoe upper 10 opposite to toe end 13. A traditional heel counter 23 (shown in phantom) is disposed on shoe upper 10 adjacent heel end 14. Foxing 26 overlies heel counter 23 in a conventional manner. A conventional mud guard 27 overlies shoe upper 10 adjacent toe end 13.

Figure 2:
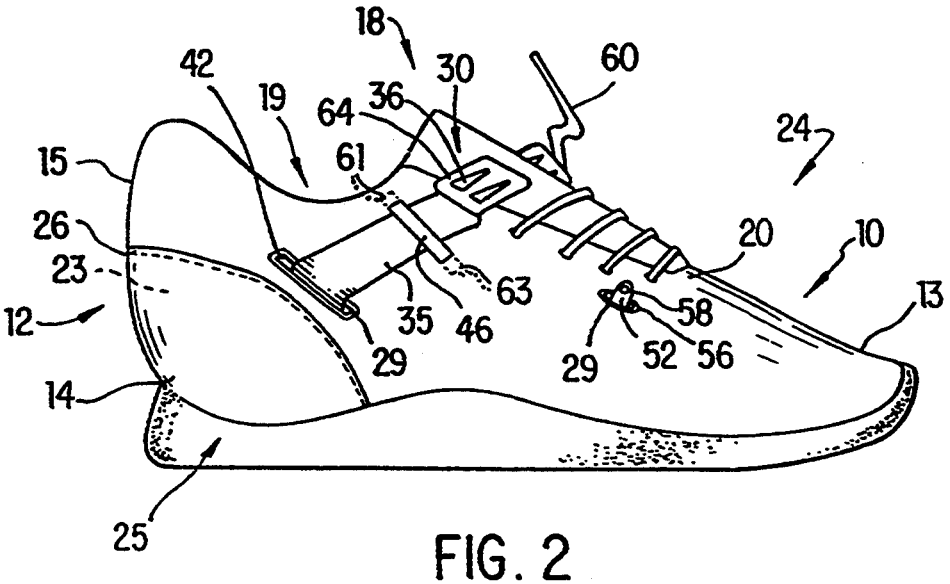
FIG. 2 is a medial side view of a shoe in accordance with the present invention.

Shoe upper 10 has a top opening 18 defined by two side portions: lateral side 11 (shown in FIG. 1) and medial side 12 (shown in FIG. 2). A portion of top opening 18 includes an ankle opening 19 which is surrounded in part by ankle collar 15. Ankle opening 19 surrounds the ankle of the foot of a wearer when the foot is inserted in top opening 18. The remaining portion of top opening 18 includes a substantially u-shaped lacing margin 16. Lacing margin 16 is provided with twelve eyelets 17 (six on each side of margin 16) for receiving a conventional shoe lace 60, as is shown in FIG. 2.

Referring to FIGS. 1 and 2, lateral side 11 includes two oval-shaped apertures 40 and 54 formed within shoe upper 10. Medial side 12 includes two oval-shaped apertures 42 and 56 also formed within shoe upper 10. Apertures 40 and 42 are oppositely disposed below collar 15. Apertures 54 and 56 are oppositely disposed adjacent the distal end 20 of lacing margin 16. Apertures 40, 42, 54 and 56 extend completely through sides 11 and 12 of shoe upper 10. Reinforcement 29 lines apertures 40, 42, 54 and 56 to prevent stresses on the apertures from causing tearing. Reinforcement 29 is made of any suitable plastic or other material.

The present invention further includes a tongue 30 disposed within top opening 18 along lacing margin 16. The toe end or base 37 of tongue 30 is secured to the interior of shoe upper 10 by any suitable manner, such as stitching.

Central to the present invention is the inclusion of straps on tongue 30. A first lateral strap 33 is disposed on the lateral side 31 of tongue 30 adjacent the ankle end or top 38 of tongue 30. A first medial strap 35 is disposed on the medial side 32 of tongue 30 adjacent top 38, directly opposite to first lateral strap 33. A second lateral strap 50 is disposed on lateral side 31 of tongue 30 adjacent base 37. A second medial strap 52 is disposed on medial side 32 of tongue 30 adjacent base 37, directly opposite to second lateral strap 50.

Figure 3:
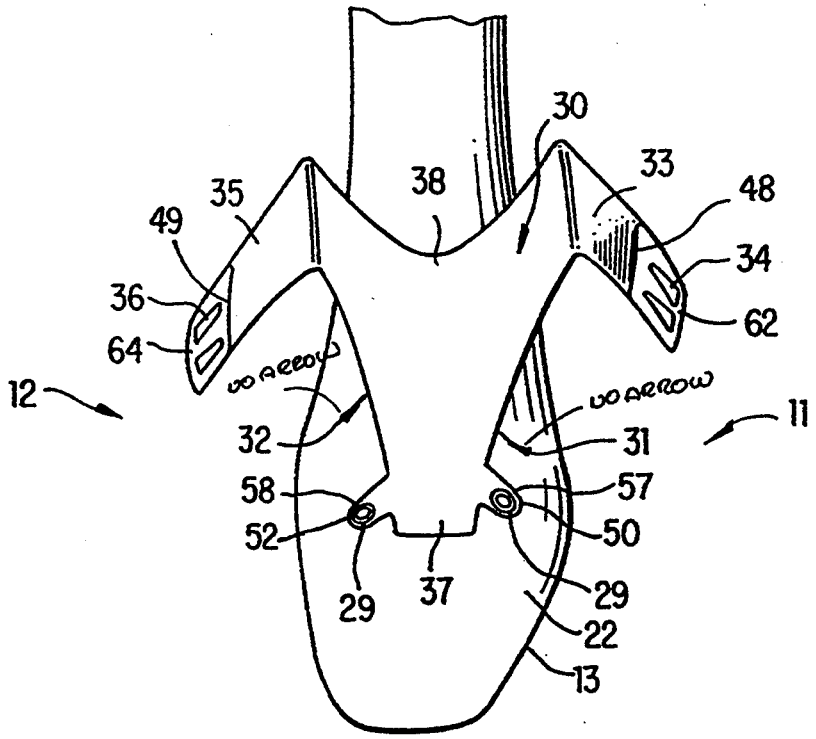
FIG. 3 is a front view of the shoe of FIG. 2 with the tongue pulled out of the upper.

Referring to FIG. 3, straps 33, 35, 50 and 52 extend outwardly from tongue 30 such that tongue 30 has an "I"-shaped appearance when removed from shoe upper 10. Tongue 30 is preferably formed of two joined layers of flexible material, such as leather, nylon or canvas, with padding disposed therebetween to provide enhanced comfort. Straps 33, 35, 50 and 52 may be unitary with and made of the same material as tongue 30. Alternatively, straps 33, 35, 50 and 52 may be separate from tongue 30 and secured thereto by any conventional means, such as stitching. If straps 33, 35, 50 and 52 are separate from tongue 30, it is preferred that straps 33, 35, 50 and 52 be made of a material having a greater degree of elasticity or flexibility than tongue 30. Such a material may be elastic gore or other stretchable material used for footwear manufacture. If an elastic material is used, it is preferred that the material used have a limited or controlled stretch, such as a LYCRA ® having a stretch capability of between one hundred and three hundred percent. (LYCRA ® is a spandex fiber available from E. I. Du Pont de Nemours & Co., Wilmington, Del.). This type of material will maintain the flexibility and comfort of shoe upper 10, while still firmly securing the foot of a wearer within the shoe. Straps 33, 35, 50 and 52 may, similar to tongue 30, be padded for enhanced comfort.

As shown in FIG. 3, straps 50 and 52 are shorter in length than straps 33 and 35. Straps 33 and 35 are each approximately five inches in length, and straps 50 and 52 are each approximately one inch in length. Straps 33, 35, 50 and 52 are preferably wider than a shoe lace, and may be approximately one-half of one inch wide. A structure this wide tends to provide a greater degree of stability, and eliminates the discomfort which could be associated with narrow straps rubbing against the foot of a wearer.

End caps 62 and 64 are disposed on the distal ends 48 and 49 of straps 33 and 35, respectively. End caps 62 and 64 are preferably formed of a suitable plastic material such as PELLETHANE TM (a thermoplastic urethane (TPU) material available from Dow Chemical Corporation, Midland, Mich.), and are secured to straps 33 and 35 by a suitable method, such as stitching or an adhesive. Openings 34 and 36 are provided within end caps 62 and 64. However, end caps 62 and 64 could be omitted and openings 34 and 36 could be formed directly within straps 33 and 35. In this regard, openings 57 and 58 are disposed directly on second lateral strap 50 and second medial strap 52, respectively. When an opening is formed directly within a strap, the opening may be reinforced to prevent tearing, as described above. Openings 34, 36, 57 and 58 provide a means through which shoe lace 60 can be threaded for securing straps 33, 35, 50 and 52 about the foot of a wearer.

A lateral retaining sleeve 44 is disposed on lateral side 11 of shoe upper 10 between lateral aperture 40 and margin 16. A medial retaining sleeve 46 is disposed on medial side 12 of shoe upper 10 between medial aperture 42 and margin 16. Sleeves 44 and 46 guide straps 33 and 35 and keep straps 33 and 35 close to sides 11 and 12 of shoe upper 10, thereby minimizing the possibility of straps 33 and 35 becoming unfastened. Sleeves 44 and 46 comprise substantially rectangular strips of material secured to upper 10 at ends 45 and 47 and 61 and 63, respectively. Alternatively, sleeves 44 and 46 may be integral with shoe upper 10. Sleeves 44 and 46 may be formed of the same material constituting shoe upper 10, or they may be formed of a different material, including a suitable plastic such as PELLETHANE TM.

In order to fully appreciate the present invention, the implementation of the tongue strapping system utilized in accordance with the present invention will now be described in detail, as applied to the preferred embodiment of the present invention set forth above. Before placing a foot in shoe 24, the wearer threads straps 33, 35, 50 and 52 through apertures 40, 42, 54 and 56, respectively, as shown in FIG. 1. Straps 33 and 35 are further threaded through sleeves 44 and 46, respectively. After the foot is inserted through top opening 18, straps 33, 35, 50 and 52 are pulled outwardly from the interior of shoe upper 10 until openings 34, 36, 57 and 58 disposed thereon are substantially aligned with eyelets 17 of lacing margin 16. Shoe lace 60 is laced through eyelets 17, openings 57 and 58, and openings 34 and 36. As shoe lace 60 is tightened, straps 33 and 35 are drawn toward one another and straps 50 and 52 are drawn toward one another, creating tension within shoe upper 10. Heel end 14 of shoe upper 10 is pulled upwardly and forwardly toward toe end 13; tongue 30 is pulled downwardly and rearwardly toward heel end 14. In addition, sides 11 and 12 of shoe upper 10 are drawn toward one another.

The controlled pressure which the tongue strapping system of the present invention generates results in shoe upper 10 having an enhanced fit. The foot of a wearer is better secured within upper 10, because the lateral, horizontal and vertical movement of the wearer's foot is minimized. The enhanced fit and security provided by the combination of shoe upper 10 and tongue 30 reduces the risk of injuries to the foot, ankle, knee and leg which are normally associated with wearing loose-fitting footwear during athletic activity. However, the structure of the present invention does not diminish the comfort or flexibility of shoe upper 10.

The foregoing description of the preferred embodiment of the invention has been presented for purposes of illustration and description. It is not intended to be exhaustive or to limit the invention to the precise form disclosed, and obviously many modifications and variations are possible in light of the above teachings. For example, while oval apertures are shown in the Figures, round, rectangular or virtually any shaped aperture may be used. In addition, while apertures 40 and 42 are shown disposed adjacent heel end 14 of upper 10 and apertures 54 and 56 are shown disposed adjacent distal end 20 of lacing margin 16, apertures 40, 42, 54 and 56 may be disposed in other positions on shoe upper 10 where they will function to improve the fit of shoe upper 10 as described. Similarly, retaining sleeves 44 and 46 may be disposed elsewhere on shoe upper 10 than that shown in the Figures, so long as retaining sleeves 44 and 46 may receive straps 33 and 35.

Figure 4:
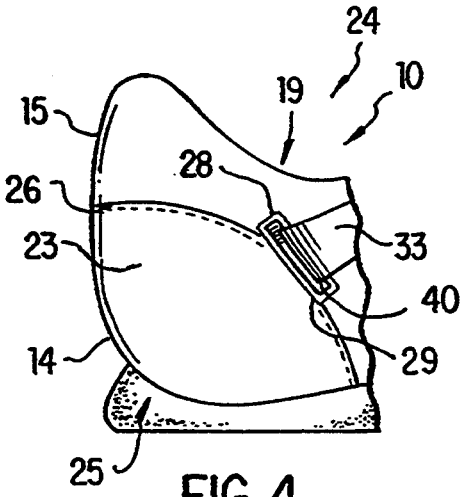
FIG. 4 is a partial side view of a shoe in accordance with another embodiment of the present invention.
Figure 5:
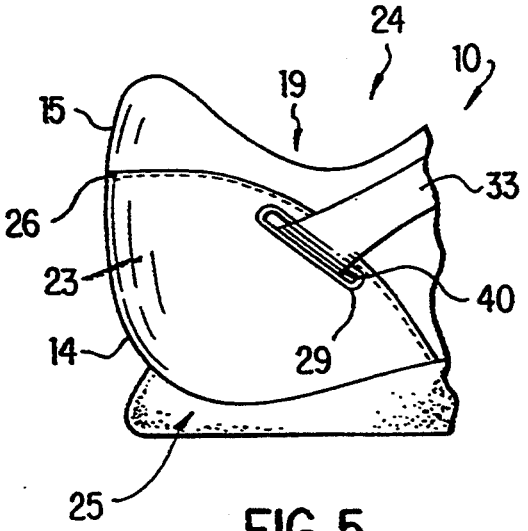
FIG. 5 is a partial side view of a shoe in accordance with a further embodiment of the present invention.

Further, although apertures 40, 42, 54 and 56 are described as being reinforced, it is not necessary that the apertures be reinforced. In another embodiment of the present invention, rather than securing reinforcement directly within the apertures, FIG. 4 shows an elongated ring 28 secured to upper 10 directly over aperture 40. Ring 28 is "D"-shaped and is secured between upper 10 and foxing 26 by a band 21 (shown in phantom). Alternatively, aperture 40 may be disposed on and extend completely through heel counter 23 and foxing 26, as shown in FIG. 5.

Furthermore, although a tongue having four straps is shown in the Figures, only two straps may be disposed on tongue 30 such that tongue 30 has a substantially "T"-shaped appearance when removed from shoe upper 10. In addition, while only straps 33 and 35 are shown to include end caps 62 and 64, straps 50 and 52 may also include such end caps. Straps 33, 35, 50 and 52 may widen towards their distal ends 48, 49, 53 and 55, so as to prevent straps 33, 35, 50 and 52 from sliding back through apertures 40, 42, 54 and 56 into the interior of shoe upper 10.

Although openings 34, 36, 57 and 58 are shown as being oval-shaped, they may, for example, be circular, elongated or teardrop-shaped, or any other suitably-shaped aperture. Further, shoe lace 60 may be replaced by any conventional fastening means. For example, a separate strap could be threaded through openings 34 and 36 on straps 33 and 35, respectively. This separate strap could then be secured at its ends by a "hook and loop" type fastener (such as VELCRO ®) or a buckle. Alternatively, strap 33 could fold back upon itself after passing through aperture 40 and sleeve 44, and distal end 48 could be fastened (such as by VELCRO ®) to the body of strap 33 adjacent aperture 40. Strap 35 could be similarly configured. A further alternate embodiment would be to connect distal ends 48 and 49 of straps 33 and 35 to one another or secure ends 48 and 49 directly to upper 10 and, rather than tension straps 33 and 35, cause shoe upper 10 to be tensioned. Such could be accomplished by placing a pressurized fluid bladder within upper 10. The insertion of fluid in such a bladder would result in straps 33 and 35 acting as restraining means to restrain the expansion of upper 10, thereby enhancing the fit of shoe upper 10. In short, shoe lace 60 may be replaced by any other suitable fastening means used in conjunction with straps 33, 35 50 and 52, whereby margin 16 and straps 33, 35, 50 and 52 are secured about the foot of a wearer, such that the foot is prevented from easily being removed from the shoe without releasing the fastening means.

It is anticipated that the preferred embodiment described above will be most effective in shoes which are intended for athletic activity, such as aerobics, running, tennis and basketball. Accordingly, although the Figures show what would typically be considered a running shoe, the present invention is equally suited for incorporation into other types of footwear. In addition, the present invention is suited for incorporation into various styles of footwear, including a "low top" shoe (shown in the Figures); a "high top" shoe and a "mid-height" shoe.

The preferred embodiment was chosen and described in order to best explain the principles of the present invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A shoe comprising:

a sole;

an upper attached said sole, said upper having a heel portion, a first side and a second side defining a top opening including an ankle opening and a lacing margin extending to said ankle opening;

a first aperture formed within said first side of said upper, said first aperture disposed rearwardly of said lacing margin;

a second aperture formed within said second side of said upper, said second aperture disposed rearwardly of said lacing margin;

a tongue affixed to and disposed within said upper adjacent said top opening;

a first strap secured to said tongue and extending through said first aperture to the exterior of said upper;

a second strap secured to said tongue and extending through said second aperture to the exterior of said upper; and fastening means in conjunction with said straps for securing said first and second straps about the foot of a wearer, wherein the fastening of said fastening means causes said tongue to be pulled downwardly and rearwardly within said shoe toward said heel portion of said upper.

2. The shoe of claim 1, further comprising:

a retaining means disposed on said upper for receiving one of said first and second straps.

3. The shoe of claim 2, wherein said retaining means comprises a sleeve.

4. The shoe of claim 3, wherein said sleeve is disposed on one of said first and second sides of said upper.

5. The shoe of claim 4, wherein said sleeve is disposed between one of said first and second apertures and said top opening.

6. The shoe of claim 1, wherein said upper further comprises a heel end and wherein said first and second apertures are formed within said upper adjacent said heel end.

7. The shoe of claim 1, wherein said upper further comprises a forefoot portion and wherein said first and second apertures are formed within said upper adjacent said forefoot portion.

8. The shoe of claim 6, further comprising:

a third aperture formed within said first side of said upper;

a fourth aperture formed within said second side of said upper;

a third strap secured to said tongue and extending through said third aperture to the exterior of said upper;

a fourth strap secured to said tongue and extending through said fourth aperture to the exterior of said upper; and wherein said fastening means secures said third and fourth straps about the foot of a wearer.

9. The shoe of claim 8, wherein said upper further comprises a forefoot portion and wherein said third and fourth apertures are formed within said upper adjacent said forefoot portion.

10. The shoe of claim 1, wherein said upper further comprises a collar and wherein said first and second apertures are formed within said upper adjacent said collar.

11. The shoe of claim 1, wherein said first strap extends from within the interior of said upper, through said first aperture, to the exterior of said upper, and said second strap extends from within the interior of said upper, through said second aperture, to the exterior of said upper.

12. The shoe of claim 1, wherein said first and second straps each include an opening for receiving said fastening means.

13. The shoe of claim 1, wherein said fastening means comprises a shoe lace.

14. A shoe comprising:

a sole;

an upper attached to said sole having a lateral side and a medial side defining a top opening including an ankle opening and a lacing margin extending to said ankle opening;

a plurality of eyelets disposed along said lacing margin;

a first lateral aperture formed within said lateral side of said upper, said first lateral aperture disposed rearwardly of said lacing margin;

a first medial aperture formed within said medial side of said upper, said first medial aperture disposed rearwardly of said lacing margin;

a lateral retaining means disposed on said lateral side of said upper between said first lateral aperture and said lacing margin;

a medial retaining means disposed on said medial side of said upper between said first medial aperture and said lacing margin;

a tongue affixed to and disposed within said top opening of said upper, said tongue including a first lateral strap and a first medial strap disposed on and extending from opposing sides of said tongue, said first lateral strap extending through said first lateral aperture and said first medial strap extending thorough said first medial aperture;

an opening disposed on said first lateral strap;

an opening disposed on said first medial strap; and fastening means in conjunction with said straps for securing said first lateral strap and said first medial strap about the foot of a wearer.

15. The shoe of claim 14, further comprising:

a second lateral aperture formed within said lateral side of said upper;

a second medial aperture formed within said medial side of said upper;

a second lateral strap disposed on and extending from a side of said tongue;

a second medial strap disposed on and extending from an opposing side of said tongue;

an opening disposed on said second lateral strap;

an opening disposed on said second medial strap; and wherein said fastening means secures said second lateral strap and said second medial strap about the foot of a wearer.

16. The shoe of claim 14, wherein said upper further comprises a heel end, and said first lateral aperture and said first medial aperture are formed within said upper adjacent said heel end.

17. The shoe of claim 15, wherein said upper further comprises a forefoot portion, and said second lateral aperture and said second medial aperture are formed within said upper adjacent said forefoot portion.

18. The shoe of claim 15, wherein said first lateral strap, said first medial strap, said second lateral strap and said second medial strap are integral with said tongue.

19. The shoe of claim 14, wherein said fastening means comprises a shoe lace.

20. The shoe of claim 14, wherein said lateral retaining means and said medial retaining means each comprise a sleeve.

21. A shoe comprising:

a sole;

an upper attached to said sole, said upper having a heel portion, a first side and a second side defining a top opening including an ankle opening and a lacing margin extending to said ankle opening;

a first aperture formed within one of said first side and said second side of said upper, said first aperture disposed rearwardly of said lacing margin;

a second aperture formed within one of said first side and said second side of said upper, said second aperture disposed rearwardly of said lacing margin;

a tongue affixed to and disposed within said upper adjacent said top opening;

a first strap unitary with said tongue and extending through said first aperture to the exterior of said upper;

a second strap unitary with said tongue and extending through said second aperture to the exterior of said upper; and fastening means in conjunction with said straps for securing said first and second straps about the foot of a wearer, wherein the fastening of said fastening means causes said tongue to be pulled downwardly and rearwardly within said shoe toward said heel portion of said upper.

22. The shoe of claim 21, wherein said first side of said upper comprises a lateral side, and said second side of said upper comprises a medial side.

23. The shoe of claim 21, wherein one of said first and said second apertures is formed within said upper adjacent said heel end.

* * * * *